US006622677B2

(12) United States Patent
Simpson et al.

(10) Patent No.: US 6,622,677 B2
(45) Date of Patent: Sep. 23, 2003

(54) WORM GEAR DRIVEN VARIABLE CAM PHASER

(75) Inventors: Roger Simpson, Ithaca, NY (US); Franklin R. Smith, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/352,689

(22) Filed: Jan. 28, 2003

(65) Prior Publication Data

US 2003/0159670 A1 Aug. 28, 2003

Related U.S. Application Data

(60) Provisional application No. 60/359,203, filed on Feb. 22, 2002.

(51) Int. Cl.[7] ..... F01L 1/34

(52) U.S. Cl. ..... 123/90.15; 123/90.17; 123/90.27; 123/90.31; 74/724; 464/160

(58) Field of Search ..... 123/90.15, 90.17, 123/90.27, 90.31; 74/724, 395, 568 R; 464/160

(56) References Cited

U.S. PATENT DOCUMENTS

| | | | | | |
|---|---|---|---|---|---|
| 1,691,408 | A | | 11/1928 | Palmer | |
| 4,517,934 | A | | 5/1985 | Papez | 123/90.17 |
| 4,747,375 | A | | 5/1988 | Williams | 123/90.15 |
| 4,856,370 | A | * | 8/1989 | Stidworthy | 74/675 |
| 5,156,119 | A | | 10/1992 | Suga | 123/90.17 |
| 5,203,291 | A | | 4/1993 | Suga et al. | 123/90.17 |
| 5,355,849 | A | | 10/1994 | Schiattino | 123/90.17 |
| 5,361,736 | A | * | 11/1994 | Phoenix et al. | 123/90.17 |
| 5,669,266 | A | * | 9/1997 | Kreuter | 74/395 |
| 5,680,837 | A | | 10/1997 | Pierik | 123/90.17 |
| 6,328,008 | B1 | * | 12/2001 | Io | 123/90.17 |
| 6,378,474 | B1 | * | 4/2002 | Pierik | 123/90.16 |
| 6,457,446 | B1 | | 10/2002 | Willmot | 123/90.17 |
| 2001/0020460 | A1 | | 9/2001 | Heer | 123/90.16 |
| 2001/0020461 | A1 | | 9/2001 | Heer | 123/90.17 |

* cited by examiner

*Primary Examiner*—Thomas Denion
*Assistant Examiner*—Ching Chang
(74) *Attorney, Agent, or Firm*—Brown & Michaels PC; Greg Dziegielewski

(57) ABSTRACT

A phaser for adjusting the timing between a camshaft and a crankshaft. The phaser consists of an outer housing having internal and external teeth and an inner housing connected to the camshaft. The outer teeth couple to the cam drive—the timing chain, timing belt or timing gears. A worm mounted on the inner housing is meshed with the internal teeth of the outer housing. The worm gear is connected to one or two drive wheels, which are rotated by contact with stationary plates. The plates are moved by electromagnetic coils to contact the drive wheel or wheels, and turn them in one direction or the other. The actuators are activated by an engine control unit. The plates can be mounted concentrically on one side of the phaser, or on opposite sides.

8 Claims, 3 Drawing Sheets

WORM GEAR DRIVEN VARIABLE CAM PHASER

REFERENCE TO RELATED APPLICATIONS

This application claims an invention which was disclosed in Provisional Application No. 60/359,203, filed Feb. 22, 2002, entitled "Worm Gear Driven Variable Cam Phaser". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of control of valve timing in internal combustion engines. More particularly, the invention pertains to a device for varying the phase relationship between a camshaft and a camshaft drive.

2. Description of Related Art

A few modern engines today are equipped with variable cam phasers. The phasers move the cam position relative to the crankshaft, usually by using engine oil pressure. When the oil pressure is low, or at engine cranking, the phaser cannot move to the advance position because the cam mean torque is too high for the low oil pressure to overcome. If the engine was stopped in this state, the phaser would be in the wrong position.

Another problem is that prior-art oil-operated cam phasers are not self-locking. Therefore, the phase of the camshaft relative to the drive (timing belt, chain or gears coupling the camshaft to the crankshaft) is constantly moving, making it difficult to obtain and hold a correct positioning for the phaser.

One example of a phaser which does not use hydraulic pressure is Palmer's "Timing Device," U.S. Pat. No. 1,691,408, issued Nov. 13, 1928, which shows a manually adjustable cam sprocket with a worm gear that is fine tuned by a screw head for an internal combustion engine.

Another example is Papez's "Controllable Camshaft for a Drive, Preferably an Internal Combustion Engine," U.S. Pat. No. 4,517,934, issued May 21, 1985, which shows an adjustment mechanism powered by an electric motor, driving a worm gear for the inner camshaft.

A third example is Suga's "Valve Timing Control Apparatus," U.S. Pat. No. 5,156,119, issued Oct. 20, 1992, which shows a pair of worm gears shifting the phaser relative to the crankshaft using engine power. The worms are driven by an axial shifting plate, which is driven by friction wheels extending out of the phaser. The friction wheels rub on friction disks that are either in front or behind the phaser to rotate the two wheels one way or the other. A solenoid pulls or pushes on the mounting of the friction disks, pushing one way or the other against the two wheels.

Suga et al.'s "Valve Timing Control System for Internal Combustion Engine," U.S. Pat. No. 5,203,291, issued Apr. 20, 1993 shows an outer housing containing internal gear teeth, which are turned by small gears. The small gears are driven by a pin on the spiral cam, which is in turn on the gear shaft. A pair of stopper pins are also present to restrict the rotation of the gear when necessary.

Schiattino's "Automatic Variator Valve Overlap or Timing and Valve Section," U.S. Pat. No. 5,355,849, issued Oct. 18, 1994, shows a worm gear driven by an electric motor, which turns or pushes a splined shaft. The turning or pushing of the shaft moves the camshaft axially to vary timing.

Pierik's "Planetary Gear Phaser with Worm Electric Actuator," U.S. Pat. No. 5,680,837, issued Oct. 28, 1997, shows a worm gear driven by an electric motor outside of the phaser. The worm gear turns the sun gear of the phaser, which moves the camshaft position relative to the crankshaft.

Williams' "Device for Controlling the Phased Displacement of Rotating Shafts," U.S. Pat. No. 4,747,375, issued May 31, 1998, describes a method of rotating a second cam that causes the resilient plunger like devices to exert a lateral force against wedge shaped valves, which causes a change in the valve lift and timing.

US published patent application US2001/0020460—"Apparatus for Adjusting a Camshaft"—describes a phaser moved by planetary gearing, using an outer housing with sprocket outside and gearing inside.

US published patent application US2001/0020461—"Apparatus for Adjusting a Camshaft"—uses three worm gears in a phaser. The worm gears are driven by six electromotors.

SUMMARY OF THE INVENTION

A phaser for adjusting the timing between a camshaft and a crankshaft. The phaser consists of an outer housing having internal and external teeth and an inner housing connected to the camshaft. The outer teeth couple to the cam drive—the timing chain, timing belt or timing gears. A worm mounted on the inner housing is meshed with the internal teeth of the outer housing. The worm gear is connected to one or two drive wheels, which are rotated by contact with stationary plates. The plates are moved by electromagnetic coils to contact the drive wheel or wheels, and turn them in one direction or the other. The actuators are activated by an engine control unit. The plates can be mounted concentrically on one side of the phaser, or on opposite sides.

DETAILED DESCRIPTION OF THE INVENTION

Figure 1:
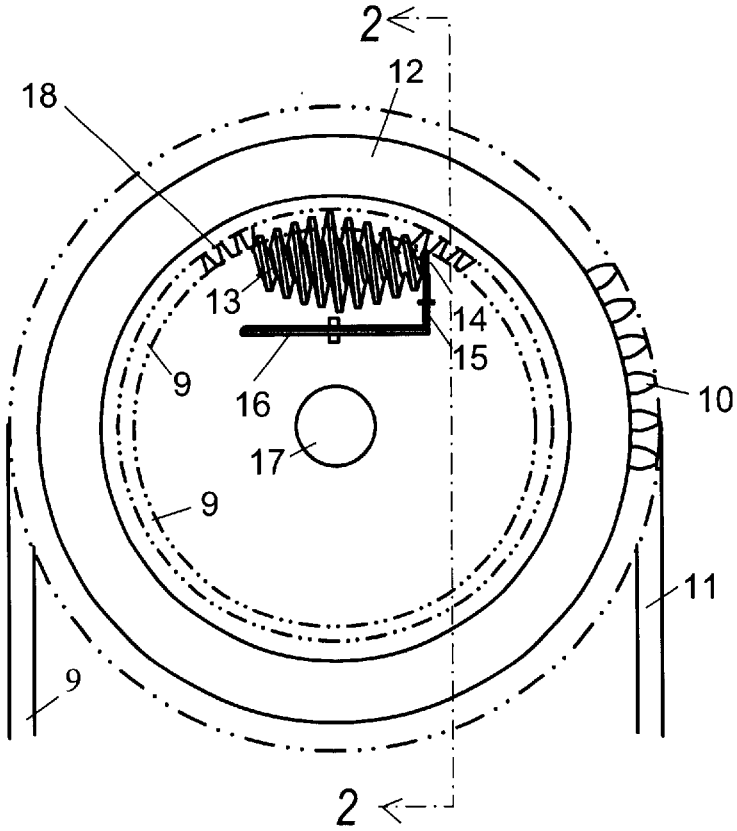
FIG. 1 shows a front view of the worm gear variable cam timing (VCT) phaser of the invention, in an embodiment having a double sided control system.

Referring to FIGS. 1 through 5, an internal combustion engine has a crankshaft, to which is driven by the connecting rods of the pistons, and one or more camshafts (17), which actuate the intake and the exhaust valves on the cylinders. The timing gear on the camshaft (17) is connected to the crankshaft with a timing drive, such as a chain (11), as shown in the figures, or a belt or gears. Although only one camshaft (17) is shown in the figures, it will be understood that the camshaft may be the only camshaft of a single camshaft engine, either of the overhead camshaft type or the in-block camshaft type, or one of two (the intake valve operating camshaft or the exhaust valve operating camshaft)

of a dual camshaft engine, or one of four camshafts in a "V" type overhead cam engine, two for each bank of cylinders.

In a variable cam timing (VCT) system, the timing gear on the camshaft (17) is replaced by a variable angle coupling known as a "phaser" (25), having a rotor connected to the camshaft (17) and a housing connected to (or forming) the timing gear, which allows the camshaft (17) to rotate independently of the timing gear, within angular limits, to change the relative timing of the camshaft (17) and crankshaft. The term "phaser" (25), as used here, includes the housing and the rotor, and all of the parts to control the relative angular position of the housing and rotor, to allow the timing of the camshaft (17) to be offset from the crankshaft. In any of the multiple-camshaft engines, it will be understood that there would preferably be one phaser (25) on each camshaft (17), as is known to the art.

FIG. 1 shows an embodiment of the invention using what will be termed "double sided control". The inner housing (18) of the phaser is attached to the camshaft (17) by a mounting plate (FIG. 2, (26)), which has an inner cavity (27) for housing part of the control mechanism, as will be described in the discussion of FIG. 2, below. The outer surface of the outer housing (12) has outer teeth (10) for coupling to timing chain (11). The outer housing (18) also has inside teeth (9), which couple to worm (13), which can be driven by gear (14). The gear (14), being smaller in diameter than the worm (13), is at a mechanical disadvantage, and is preferably beveled. The gear (14) meshes with an intermediate gear (15), which is also preferably beveled and which in turn meshes with drive wheel (16), which is mounted to one side of the axis of the camshaft.

The intermediate gear (15) and drive wheel (16) are angle cut to mesh with each other, the axes of the two being at right angles, and the axis of the drive wheel (16) being parallel to the axis of the worm (13). The intermediate gear (15) provides a means for coupling the rotation of the drive wheel (16) to the gear (14), and thus to the worm (13). It will be recognized by one skilled in the art that the axis of rotation of the drive wheel (16) could be perpendicular or parallel to that of the worm (13), or other arrangements, within the teachings of the invention, so long as the drive wheel is coupled to the worm for rotation.

The worm (13), gear (14), intermediate gear (15) and drive wheel (16) are all mounted to the inner housing (18), and thus rotate with the camshaft (17). The drive wheel (16) is actuated by a double-sided control mechanism, which is removed in FIG. 1 to show the mechanism more clearly, and which is shown in section in FIG. 2.

Because the drive wheel (16) is mounted off-axis relative to the camshaft (17), and rotates with the camshaft (17), it will be understood by one skilled in the art that if a stationary plate is brought into contact with the drive wheel (16) while the camshaft (17) is rotating, the drive wheel will be caused to rotate in one direction if the stationary plate is in front of the wheel (16), and in the other direction if the plate is behind the wheel (16). This is the operating principle of the double-sided control mechanism of the embodiment of FIGS. 1 and 2.

Figure 2:
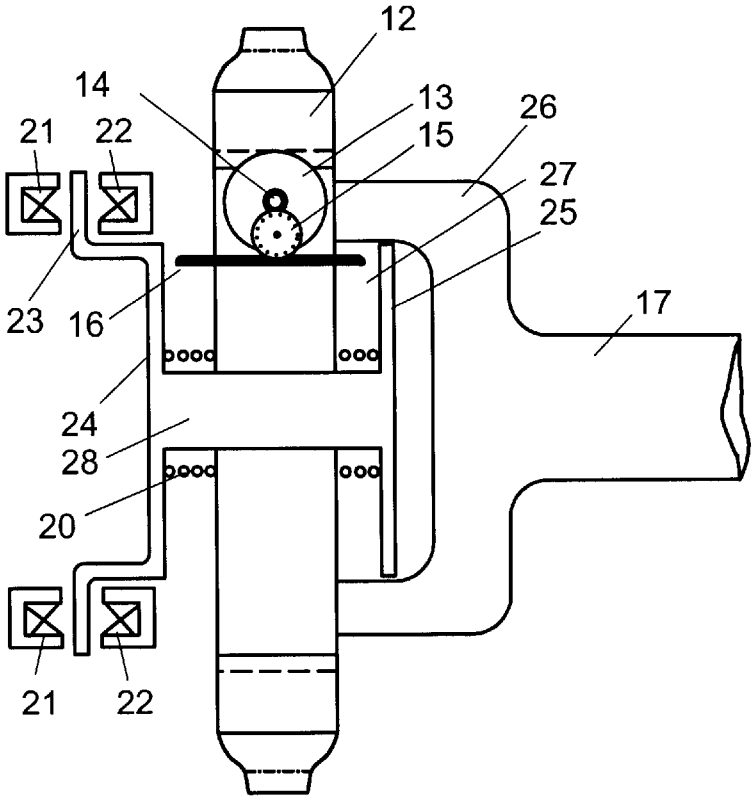
FIG. 2 shows a side sectional view of the worm gear VCT phaser of FIG. 1, along the lines 2—2 in FIG. 1.

Referring to FIG. 2, the double sided control assembly is made up of an advance plate (25) and a retard plate (24), connected by a shaft (28). The advance (25) and retard (24) plates are on opposite sides of the inner housing (18) of the phaser, and the shaft (28) is of sufficient length that when the mechanism is centered by springs (20), neither plate (24) or (25) contacts the drive wheel (16). Actuating plate (23) extends forward and radially outward from retard plate (24), and is connected to the control assembly such that when the actuating plate (23) is moved forward, the advance plate (25) contacts the rearward edge of the drive wheel (16), rotating it in one direction. Similarly, when the actuating plate (23) is moved rearward, the retard plate (24) contacts the forward edge of the drive wheel (16), rotating it in the opposite direction. It will be understood by one skilled in the art that the terms "advance" and "retard" refer to rotation of the camshaft relative to the crankshaft, and in this context the choice of "advance" or "retard" for the plates is arbitrary, and the actual effect of contacting the drive wheel with these plates will depend on the direction of rotation of the camshaft and camshaft.

The actuating plate (23) is drawn forward by advance coil (21), and rearward by retard coil (22), under the control of an engine control unit, not pictured here, which applies electric current to one of the actuators or coils (21)(22), to turn it on and move the actuating plate (23). When the engine control unit signals the advance coil (21) to turn on, the actuating plate (23) is pulled toward the coil (21), moving the advance plate (25) into contact with the drive wheel (16). The contact between the advance plate (25) and the drive wheel (16) causes the drive wheel (16) to rotate in a certain direction, which then causes the intermediate gear (15), that is angle cut to mesh with the drive wheel (16), to rotate relative to the direction of the drive wheel (16), which then causes the gear (14) to rotate relative to the intermediate gear (15), and the worm (13) to rotate relative to it. The rotation of the worm (13) causes the camshaft (17) to adjust and move ahead or advance relative to the crankshaft. Stopping the current to the advance coil (21) allows the springs (20) to re-center the control mechanism, and take the advance plate (25) out of contact with the drive wheel (16). The phaser will remain at this same position until there is another signal from the engine control unit to move the plates (24)(25) into another position.

Figure 3:
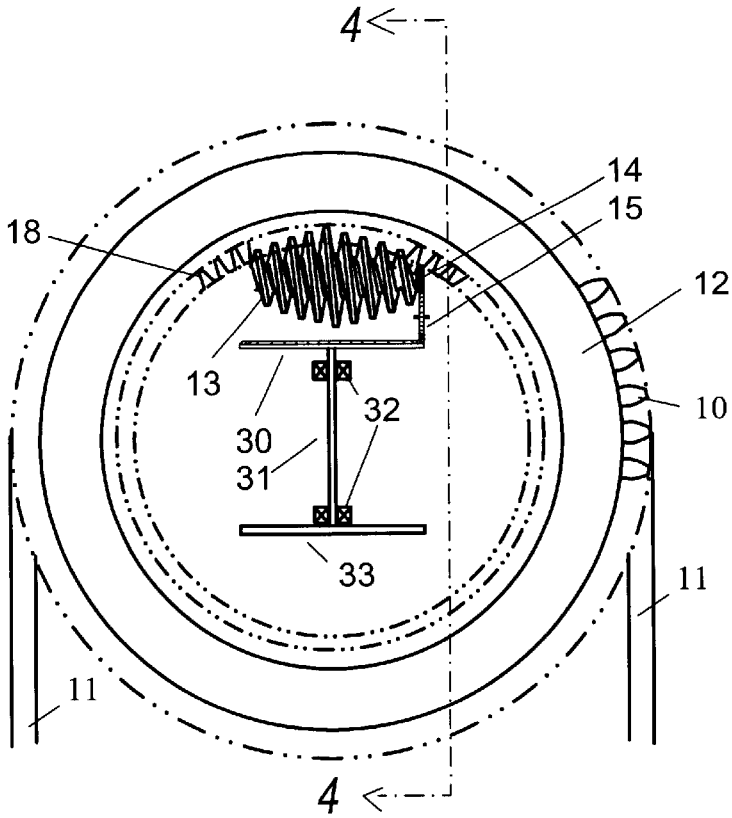
FIG. 3 shows a front view of the worm gear VCT phaser of the invention, in an embodiment having single sided control.
Figure 4:
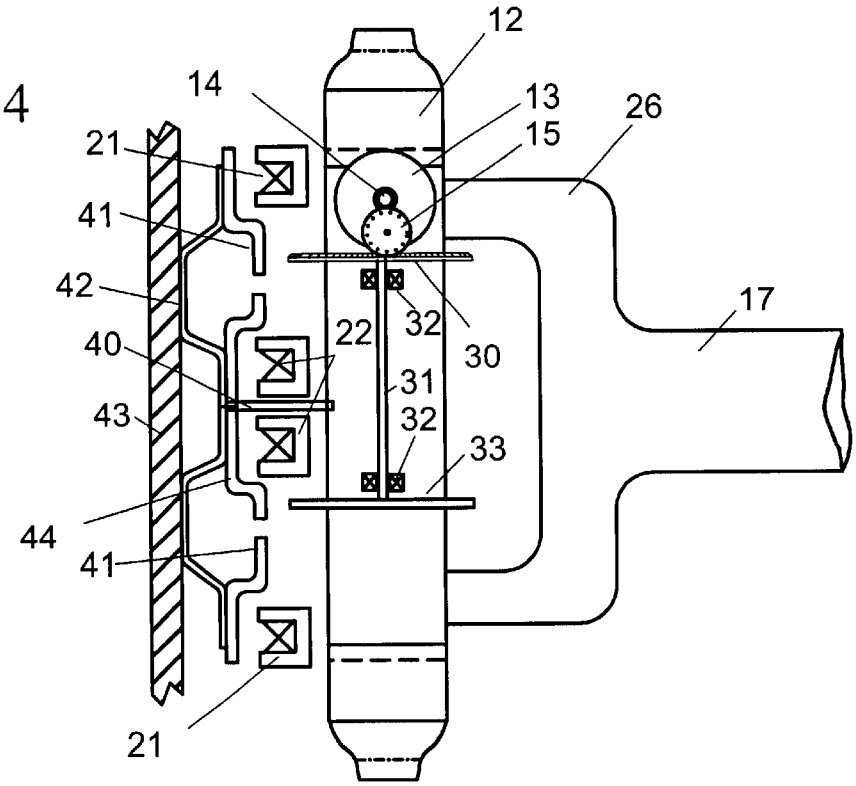
FIG. 4 shows a side sectional view of the worm gear VCT phaser of FIG. 3, along the lines 4—4 in FIG.3.

FIGS. 3 and 4 show an alternate embodiment of the invention, using a single-sided control mechanism. In this embodiment, there are two drive wheels (30) and (33), connected by shaft (31), which is perpendicular to the axis of the worm (13). Bearings (32) maintain the shaft's (31) alignment relative to the worm (13). Drive wheel (30) is preferably partially beveled and couples to intermediate gear (15), and intermediate gear is coupled to gear (14) as described in a previous embodiment. Drive wheel (33) is preferably not beveled. The drive wheels (30) and (33) are located on opposite sides of the camshaft (17) axis, at different distances from the camshaft (17) axis, so that if drive wheel (30) is contacted by a stationary retard plate (44) on the front of the phaser, shaft (31) turns in one direction, and if drive wheel (33) is contacted by a stationary advance plate (41) also on the front of the phaser, shaft (31) turns in the opposite direction.

By locating the drive wheels (30) and (33) at different distances from the camshaft (17), the advance (41) and retard (44) plates can be formed as concentric rings, mounted to the stationary timing chain cover (43) by straps or springs (42). A shaft (40) keeps the rings (41) and (44) centered. The advance plate (41) is pulled inward into contact with drive wheel (33) by advance coil (21), and the retard plate (44) is pulled inward into contact with drive wheel (30) by retard coil (22). When a coil is not activated, straps (42) return the plate to a neutral position (not in contact with a wheel).

Because of the differing distances from the camshaft (17) axis, the amount of mechanical advantage on wheels (30)

and (33) will differ, as well as the relative rotational speeds of the rotating phaser at different radial distances relative to the stationary plates. To compensate for this, drive wheels (30) and (33) may be formed with differing diameters.

Figure 5:
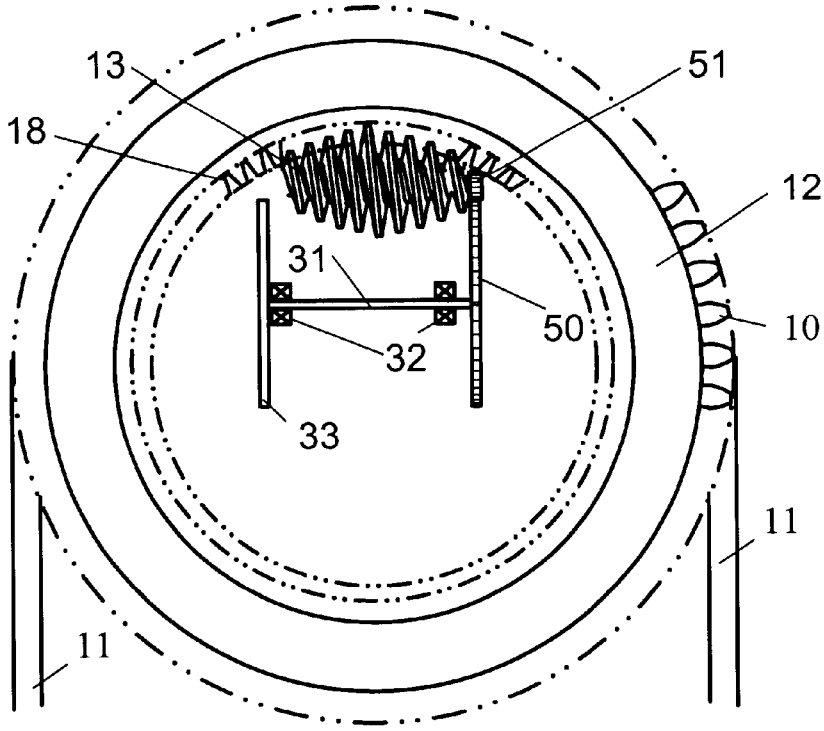
FIG. 5 shows a front view of the worm gear variable cam timing (VCT) phaser of the invention, in an alternative embodiment.

The drive wheels (30) and (33) are shown in FIGS. 3 and 4 as being parallel to one another connected by a shaft (31). In another alternative embodiment, as shown in FIG. 5, the drive wheels (33) and (50) are still parallel to one another and are connected by a shaft (31), but the shaft is parallel (31) to the axis of the worm (13). Drive wheel (50) is preferably straight cut and meshes with a preferably straight cut gear (51).

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A phaser for adjusting the rotational phase between a camshaft and a crankshaft of an engine comprising:

an outer housing having an outer periphery for coupling to the crankshaft by a drive means and an inner periphery forming a spur gear with inward-facing teeth;

an inner housing coupled to the camshaft for rotation therewith;

a worm gear mounted to the inner housing, meshed with the inward-facing teeth of the outer housing, such that rotation of the worm causes the outer housing to shift rotational position relative to the inner housing;

at least one drive wheel mounted to the inner housing, coupled to the worm for rotation thereof, having a rotational axis perpendicular to and radially spaced apart from, a rotational axis of the camshaft; and an actuator comprising an advance plate and a retard plate, each of the advance plate and the retard plate being rotationally stationary relative to the camshaft, and movable from a first position in contact with at least one drive wheel to a second position not in contact with at least one drive wheel, such that when the advance plate is moved to the first position when the camshaft is rotating, the at least one drive wheel is caused to rotate, rotating the worm in a first direction, and when the retard plate is moved to the first position when the camshaft is rotating, the at least one drive wheel is caused to rotate, rotating the worm in an opposite direction to the first direction.

2. The phaser of claim 1, further comprising an intermediate gear coupling the worm gear to the at least one drive wheel.

3. The phaser of claim 1, further comprising an advance coil and a retard coil, such that electrical actuation of the advance coil moves the advance plate into the first position, and actuation of the retard coil moves the retard plate into the first position.

4. The phaser of claim 1, in which there is one drive wheel, the advance plate is located on one side of the rotational axis of the drive wheel, and the retard plate is located on an opposite side of the rotational axis of the drive wheel.

5. The phaser of claim 4, in which the advance plate is coupled to the retard plate, such that when one of the advance plate or the retard plate is in the first position, the other of the advance plate or the retard plate is in the second position.

6. The phaser of claim 1, in which the at least one drive wheel comprises a first drive wheel and a second drive wheel, and the first drive wheel and the second drive wheel are rotationally coupled together and located on opposite sides of a rotational axis of the camshaft.

7. The phaser of claim 6, in which when the advance plate is in the first position, the advance plate contacts the first drive wheel, and when the retard plate is in the first position, the retard plate contacts the second drive wheel.

8. The phaser of claim 7, in which the advance plate and the retard plate are concentric disks.

* * * * *